United States Patent [19]

Diesner

[11] 3,993,105

[45] Nov. 23, 1976

[54] METHOD OF AND A MACHINE FOR MANUFACTURING NAP FABRIC STRIP CLOSURE DEVICES

[75] Inventor: Ferdinand Diesner, Murg-Hanner, Germany

[73] Assignee: Patax Trust Reg., Switzerland

[22] Filed: July 3, 1975

[21] Appl. No.: 592,903

[30] Foreign Application Priority Data

Oct. 29, 1974 Switzerland ..... 14504/74

[52] U.S. Cl. ..... 139/291 C; 139/21; 28/72 P

[51] Int. Cl.[2] ..... D03D 39/16

[58] Field of Search ..... 139/11, 20, 21, 22, 139/291 C, 397, 398; 28/72 P

[56] References Cited

UNITED STATES PATENTS

| | | | |
|---|---|---|---|
| 695,582 | 3/1902 | Rosgen | 139/397 |
| 1,524,398 | 1/1925 | Kenney | 139/21 |
| 2,025,866 | 12/1935 | Holmes | 139/20 |
| 3,320,649 | 5/1967 | Naimer | 28/72 P |

FOREIGN PATENTS OR APPLICATIONS

| | | | |
|---|---|---|---|
| 1,463,280 | 1/1966 | France | 139/291 C |

*Primary Examiner*—Henry S. Jaudon
*Attorney, Agent, or Firm*—McGlew and Tuttle

[57] ABSTRACT

Two nap fabric strips for strip closure devices are woven simultaneously in a shuttle-less loom from respective weft and first warp threads. Second warp threads are fed through the shed-forming device of the loom and woven into the strips alternately so that portions of the second warp threads interconnect the strips. The interconnecting portions of the second warp threads are cut to disconnect the strips and to provide each strip with a plurality of knubs each having a deformed end portion. The second warp threads are fed through a storage mechanism, which is disposed upstream of the shed-forming device and which is so controlled that — while the second warp threads are being woven into the respective strips — the second warp threads are fed through the shed-forming device at a slower rate than that at which they are fed during the formation of the second warp thread portions interconnecting the two strips. Preferably, nap loops are formed on at least one of the strips by introducing a free end portion of an elongate flexible rod member into a shed defined between components of the first warp threads of the one strip and the second warp threads. The flexible rod member is displaced towards the woven edge of the one fabric strip so that an intermediate portion of the rod member is flexed with portions of the second warp threads wrapped around the free end portion of the rod member. The rod member is secured in its flexed position at least until the beating up of the next weft thread and is subsequently completely withdrawn from the shed.

5 Claims, 11 Drawing Figures

METHOD OF AND A MACHINE FOR MANUFACTURING NAP FABRIC STRIP CLOSURE DEVICES

BACKGROUND OF THE INVENTION

The present invention relates to a method of making nap fabric strips for strip closure devices and to a strip-weaving machine for carrying out the method.

There are known closure devices comprising two strips, which possess on one side of each strip coupling means disposed in a laminar manner. One strip possesses knubs with deformed free ends. The free ends are either curved to a hook-shape or possess mushroom-shaped or club-shaped thickenings which act as barbs.

The method of making the strips hitherto has been first to weave a fabric possessing nap loops on a strip loom. To produce knubs with deformed free ends, the nap loops were then cut open on a second machine and deformed and stabilised by thermal treatment on a third machine. With this method of production, several machines were therefore necessary for the making of the strips. In addition, the transporting of the strips from the one to another machine naturally increased the amount of work.

From Swiss patent application No. 3854/73 is already now known a method which makes it possible to manufacture, in one operation on a single machine strips possessing knubs deformed to a mushroom shape. In this known method, two strips, extending in one section parallel to each other behind the edge of the fabric, are woven simultaneously. In the weaving, pile warp threads are introduced and woven in alternately into the basic weaves of each of the two strips in such a manner that they constitute connecting sections joining together the two basic weaves approximately perpendicularly to each other. The two weaves are heated up behind the edge of the fabric, in order that the pile warp filaments shall bond satisfactorily in the basic weave, and are then again cooled. Finally, the connecting sections are separated in the middle using a heated wire. By suitably selecting the temperature of the heated wire, the connecting sections are so melted during the cutting that mushroom-shaped, stable knubs are produced.

In this method, the strips possessing the deformed knubs, can, as already mentioned, be manufactured on one machine. This machine however, by comparison with weaving of strips without knubs, permits only a relatively low speed of weaving.

When the connecting sections are formed, the shed-forming device must transport the pile warp filaments from the shed of the one strip into the shed of the other strip during shed changing. This means that considerably longer pile warp thread sections are necessary than with those shed changes in which the pile warp threads are woven into the strips. In the forming of the connecting sections, the pile warp threads must therefore be fed to the shed-forming device at a higher speed than when weaving into the basic weave. In the already known method, the pile warp threads are stressed using a spring-loaded or weight-loaded thread tensioning device, in order to compensate the differing thread speeds between the warp beam or warp bobbins and the shed-forming device. It has however now been found that with a thread speed compensation of this type, only relatively low weaving speeds are possible, since otherwise uneven and unacceptably large thread tensions result. This disadvantage becomes further intensified by the fact that, in order to form the knubs, there ae normally used pile warp threads, which are of a different material from, and which possess a greater stiffness than, the basic warp and weft threads serving for forming the basic weave.

The stiffness of the pile warp threads necessitates, with the known method however, even where the pile warp threads are woven into the basic weave, a relatively low weaving speed, since otherwise relatively loose weaves result, in which the knubs are unsatisfactorily anchored.

SUMMARY OF THE INVENTION

According to one aspect of the present invention, there is provided a method of manufacturing nap fabric strips for strip closure devices, the method comprising the steps of simultaneously weaving two fabric strips having mutually facing surfaces in a shuttle-less strip loom from respective weft and first warp threads, feeding second warp threads through a shed-forming device so that the second warp threads are woven into the respective strips alternately and so that portions of the second warp threads interconnect the two strips, and cutting the interconnecting portions of the second warp threads to disconnect the two strips and to provide each strip with a plurality of knubs having deformed end portions, the second warp threads being fed through a storage mechanism, which is disposed upstream of the shed-forming device and which is so controlled that — during periods when the second warp threads are being woven into one or the other of the respective strips — the second warp threads are fed at a first rate and — during periods when the interconnecting second warp thread portions are being formed — the second warp threads are fed at a second rate greater than the first feed rate.

Thus, the method embodying the invention enables the weaving speed to be considerably increased compared to known methods of simultaneously weaving two mutually facing nap fabric strips for a closure device.

The warp filaments may be heated in the region of the sheds and of the edge of the fabric. This causes the second or pile warp threads to become very flexible, so that they also can be woven at high speed into the basic weave and thoroughly anchored there.

Nap loops may also be formed, additionally to the knubs having the deformed free ends, in the same operation. This has the advantage that only one type of strip has to be manufactured for a strip closure device and that only one loom is necessary.

According to another aspect of the present invention, there is provided a strip loom for carrying out the method described above, the strip loom comprising respective feeder devices for feeding two sets of first warp threads and a set of second warp threads towards a shed-forming device, the shed-forming device being adapted to divide each set of first warp threads into respective sheds for simultaneously weaving two fabric strips and to so guide the second warp threads that the latter are woven into the respective strips alternately with portions of the second warp threads interconnecting the two strips, and a cutter device for cutting the interconnecting portions of the second warp threads to separate the two strips from one another and to provide each strip with a plurality of knubs having deformed end portions, wherein the feeder device for feeding the second warp threads comprises a feeder mechanism for drawing the second warp threads at substantially constant speed from warp thread supply means, a storage mechanism provided with a movable thread tensioning device disposed to engage the second warp threads extending between the feeder mechanism and the shed-forming device, and a drive mechanism to so actuate the thread tensioning device in synchronism with the operation of the shed-forming device that — while the second warp threads are being woven into one or the other of the respective fabric strips — the second warp threads are fed at a first feed rate and — while the interconnecting second warp thread portions are being formed — the second warp threads are fed at a second feed rate greater than the first feed rate.

BRIEF DESCRIPTION OF THE DRAWINGS

Embodiments of the invention will now be more particularly described by way of example with reference to the accompanying drawings, in which.

DESCRIPTION OF THE PREFERRED EMBODIMENTS

Figure 1:
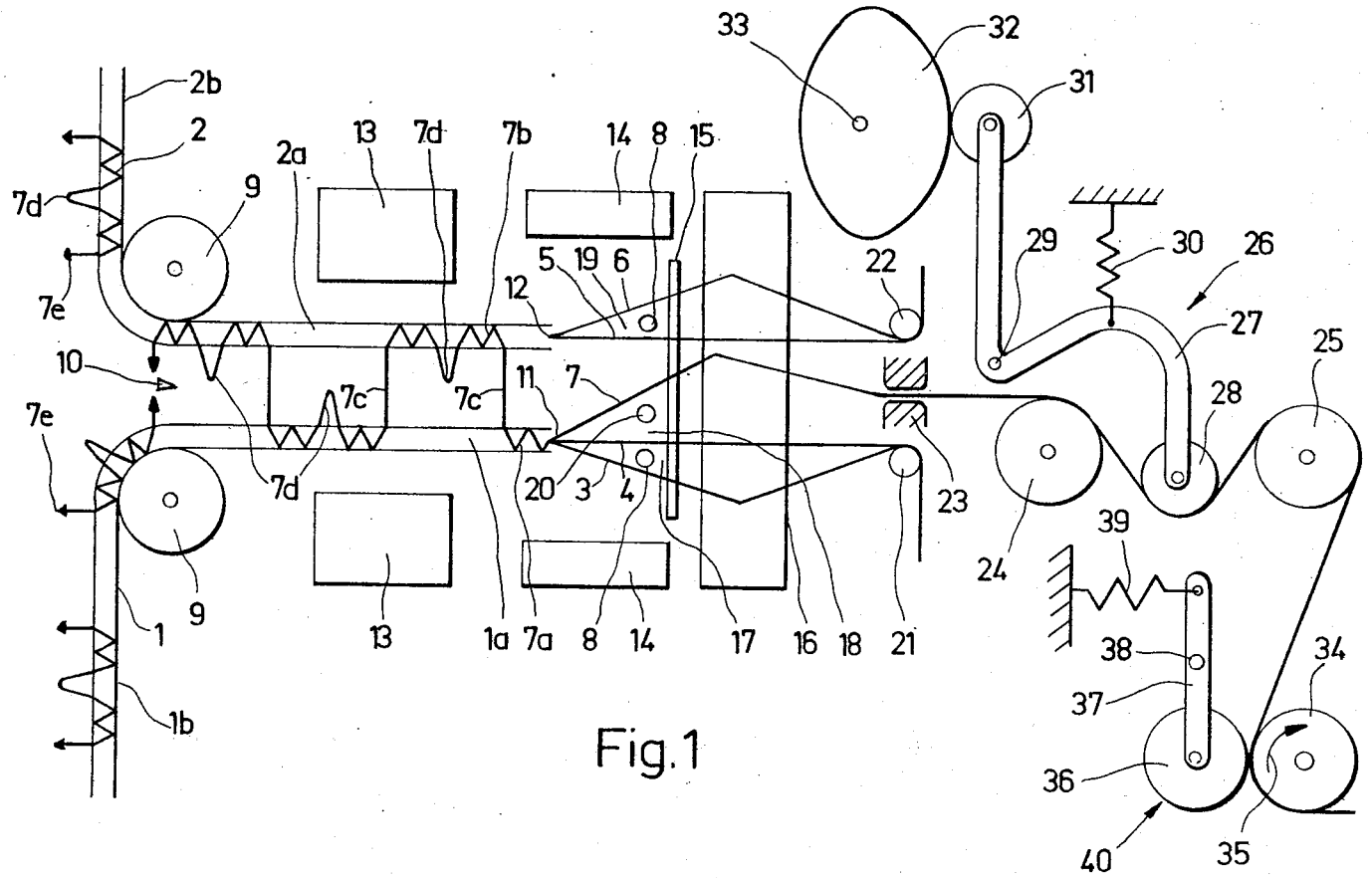
FIG. 1 is a diagrammatic side section through a strip loom.

FIG. 1 shows diagrammatically a shuttle-less strip loom for manufacturing nap fabric strips for strip closure devices. The references 1 and 2 in FIG. 1 indicate two nap fabric strips. The strip 1 possesses a basic weave 1*b*, which is woven from a basic warp 3, 4 constituted of the first warp threads 3 and 4, and from a weft thread, not shown. The strip 2 comprises a basic weave 2*b*, which is woven from first warp threads 5 and 6 and from a weft thread, likewise not shown. During the weaving operation, the two strips 1 and 2 are conveyed by conveying means, of which only the two rolls 9 are shown, and are guided through non-indicated strip holders in such a manner that they possess two sections 1*a* and 2*a* extending parallel to each other between the respective fabric edges 11 and 12 and the rolls 9. In addition, the section 2*a* is exactly over the section 1*a*, so that the upper surface of the basic weave 1*b* is facing towards the lower surface of the basic weave 2*b*.

FIG. 1 shows, furthermore, a reed 15, serving for beating up the weft threads, and a shed-forming device 16. Through the latter, during weaving, there are supplied, in addition to the first or basic warp threads 3, 4, 5, 6, also second or pile warp threads 7, which serve for forming nap loops 7*d* and nap knubs 7*e* with deformed free ends. The pile warp threads 7 are raised and lowered by the shed-forming device 16 in such a manner that they are woven alternately into the basic weave 1*b* of the lower strip section 1*a* and into the basic weave 2*b* of the upper strip section 2*a*. The second or pile warp threads 7 may, for example, execute, during two successive shed changes, the same movements as the first or basic warp threads 4 of the lower basic warp 3, 4 and therefore form, in conjunction with the basic warp 3, 4, a lower shed during the two shed changes. The basic warp threads 5, 6 each constitute, during this phase, an upper shed.

After each shed is formed, a loop of weft thread is introduced by a weft thread feed apparatus 8 into each lower and upper shed, then held by a securing device and secured and beaten up by means of the reed 15 against the fabric edges 11, 12 respectively. The pile warp threads 7 here constitute the sections 7*a* woven into the basic weave of the lower strip 1.

Next, the pile warp threads 7 can be raised by the shed-forming device 16 into the position shown in FIG. 1. At this instant, the basic warp threads 3 and 4 constitute a first, lower shed 17. The basic warp threads 4 and the pile warp threads 7 constitute a second shed 18 above this. The warp threads 5, 6 serving for weaving the upper strip 2 are divided into a shed 19. A loop of weft thread is then introduced into the lowest, first shed 17 and into the uppermost shed 19 and gripped by a securing device. By contrast, a flexible elongate element, namely a rod 20, is pushed into the second shed 18 belonging to the lower strip 1. This operation is illustrated in FIG. 2.

Figure 2:
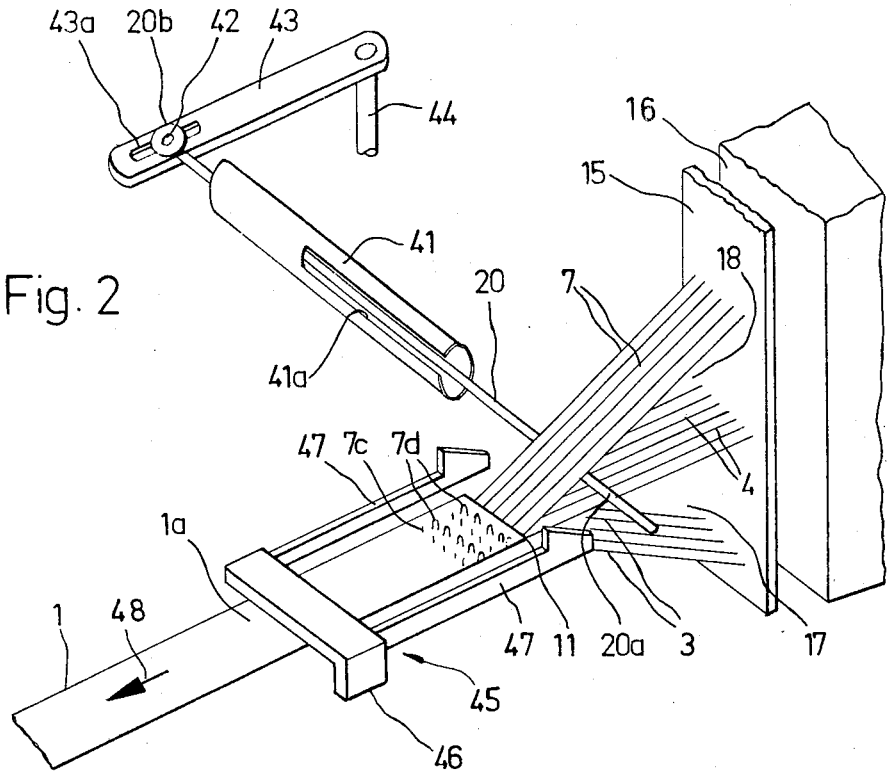
FIG. 2 is a perspective view of some elements of a strip loom to a larger scale, at the instant at which the rod serving for forming nap loops is introduced.

FIG. 2 shows a perspective view of the lower strip 1 in the vicinity of the fabric edge 11. For clarity, the upper strip 2 has been shown omitted, the connecting sections 7*c* cut away and the rod 20 with an excessive diameter. The strip loom possesses guide means, namely a sleeve 41. This is mounted on the machine frame in such a manner that its longitudinal axis extends approximately perpendicularly to the strip 1 and to the warp threads and is pointed towards the second shed 18. The portion of the sleeve nearest to this shed is furnished, on its side remote from the shed-forming device 16, with a longitudinal slit 41*a*. The rod 20 is slidably guided in the sleeve 41. The forward, free end section 20*a* of the rod 20 passes through the second shed 18 at the instant depicted in FIG. 2. The rear end of the rod 20 is furnished with an enlargement 20*b* and connected to a pin 42. This pin penetrates into the slot 43*a* of a pivoting arm 43, which is mounted on a shaft 44, executes a reciprocating motion in operation and serves as driving apparatus for the rod 20.

The strip loom possesses also a gripper 45 comprising a support 46 attached to the machine frame and two hooks 47 secured to this support. These two hooks 47 of the gripper 45 are disposed alongside the edges of the strip, somewhat above the edges 11.

The reed 15 is so constructed that it can be pushed through between the free ends of the hooks 47.

If the weft threads introduced are now beaten up by the reed 15 against the fabric edges 11 and 12 and secured, the free rod end section 20*a* pushed into the shed 18 is transported by the reed 15 up to the fabric edge 11.

Figure 3:
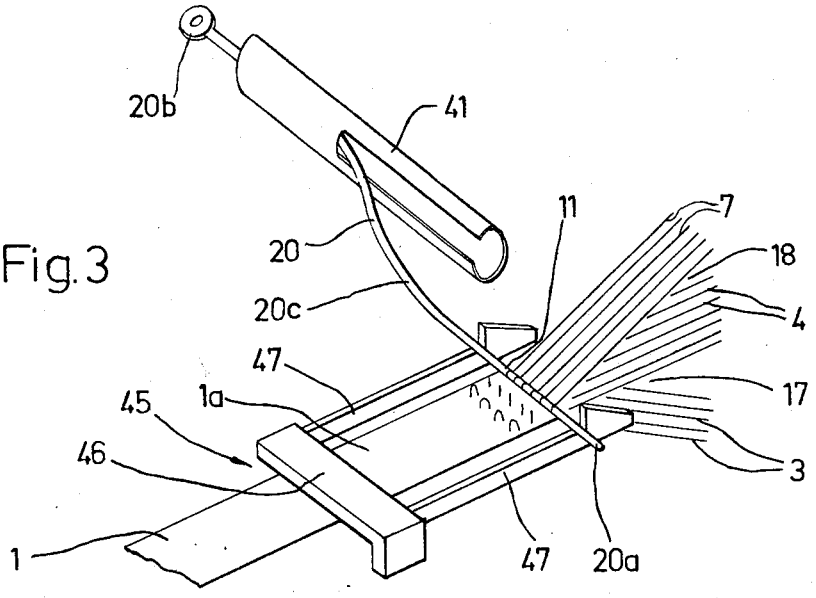
FIG. 3 shows some of the elements illustrated in FIG. 2, at the instant at which the free end of the rod is situated at the edge of the fabric.

The pushed-in rod end section 20*a* arrives at the position shown in FIG. 3, with bending of the rod portion 20*c* situated outside the region of the warp threads 3, 4 and 7. The rear portion of the rod with the enlargement 20*b* is here held firmly in its position by the guide apparatus 41. The gripper 45 now holds the free end section 20*a* of the rod firmly in the vicinity of the fabric edge 11 in such a way that it extends in a plane perpendicular to the longitudinal direction of the strip section 1*a* and therefore also to the conveying direction 48. In addition, the end section is firmly held in such a manner that it rests upon the upper face of the basic weave or is situated a little above it.

When the weft thread section is introduced and the rod end section 20*a* is conveyed to the fabric edge 11, a change of shed simultaneously takes place, the pile warp threads 7 now moving into the lowest layer of warp. In this manner, the pile warp threads 7 form a row of nap loops 7*d*. In order that these shall not be drawn back into the basic weave when the warp pile threads are pulled up, the rod 20 must be held firmly in position at least until the next weft has been introduced and beaten up against the fabric edge.

After the forming of these nap loops 7*d*, the pile warp threads 7 are again woven into the strip 1, during approximately two shed changes.

After the beating up of the weft following upon the forming of loops, or after several introductions of weft and shed changes, the rod 20 is again pulled out by the pivoting arm 43 from the region of the strip 1. The rod 20 is sufficiently elastic to re-adopt its initial, straight shape. It is now ready for the forming of a further row of nap loops.

The pivoting arm 43 must of course be driven synchronously with the shed-forming device 16 and with the weft thread introducing apparatus 8.

Since the rod 20 is flexible and is of negligible mass, it can, after introduction, immediately be pulled up against the fabric edge 11 as rapidly as the weft threads are beaten up. The forming of the nap loops can thus be carried out equally rapidly to the weaving of a normal strip.

The pile warp threads 7 are next raised to the uppermost layer of basic warp threads of the upper basic warp 5, 6. In doing this, the pile warp threads 7 form connecting sections 7*c*, which join together the two basic weaves 1*b* and 2*b* in the strip sections 1*a* and 2*a* respectively. The connecting sections 7*c* extend approximately perpendicularly to the two strip sections 1*a* and 2*a*.

The pile warp threads 7 are then woven into the upper strip 2 during approximately two shed changes, so that the thread sections 7*b* are formed. In the upper strip 2, nap loops 7*d* can then likewise be formed by means of a rod.

The strip loom possesses heating elements 14, such as infra-red radiators or hot air blowers, disposed in the region between the shed-forming device 16 and the fabric edges 11, 12 respectively. In an especially favorable form of embodiment, the reed 15 is, in addition, also equipped with a heating element. With these heating elements, the warp threads can be heated up in the region of the sheds and of the fabric edge. This has the advantage that the pile warp threads, consisting of plastics, which are normally somewhat stiffer than the other threads, become flexible and can be woven in tightly into the basic weave. In addition, the pile warp threads are melted to a certain extent at the surface by the heating up, so that they bond to the other threads and are thoroughly anchored in the basic weave.

Between the fabric edges 11, 12 and the rolls 9, cooling elements 13, such as air blowers, are disposed, by which the fabric is again cooled down to room temperature. Instead of air blowers, cooling elements bearing against the strips, such as water-cooled plates, can also be used. The connecting sections 7*c* are stabilised in their vertical position by this cooling. Near the rolls 9 there is disposed, in the middle between the two strip sections 1*a* and 2*a*, a cutting heater device 10, extending over the entire width of the strips 1 and 2. The cutting heater device 10 can perhaps be formed by a heating wire, which has current flowing therethrough and which displays a wedge-shaped cross-section. The acutely-angled end of the wedge is, in that case, facing the shed-forming device 16. For compensation of the change of length taking place on the heating up, the cutting heating device 10 is expediently tensioned by springs. Furthermore, a monitoring device is advantageously present, which switches off the strip loom when the cutting heater device 10 is torn or fused.

When one of the connecting sections 7*c*, during the conveying of the strips 1 and 2, arrives at the cutting heater device 10, it is cut by this into two parts. The temperature of the cutting heater device 10 is so selected that the pile warp threads can melt at the points of cutting, so that a deformation takes place and the free ends of the pile warp threads become thickened. In this manner, mushroom-shaped or club-shaped knubs 7*e* are formed, which again solidify completely during the subsequent cooling. The strip 1 is then deflected around the lower roll 9 downwards and is wound on a winding apparatus, not shown.

The strip 2 is deflected upwards about the upper roll 9 and likewise wound up.

In an especially favorable form of embodiment of this method, the basic warp threads which and weft threads are used in the manufacture of the two strips 1, 2, which are of a material which is not fusible or possesses a higher fusion point than the pile warp thread material. For example, cotton or polymide threads (nylon) can be used for making the basic weave and polypropylene threads may be used for forming the knubs.

The basic warp threads 3, 4, 5, 6 are supplied to the shed-forming device from a feed device comprising warp bobbins or warp beams. Only two guide rolls 21 and 22 of this feed device are illustrated in FIG. 1.

For the feed of the pile warp threads serving for forming the knubs, a separate feed device is provided, which will now be explained. This feed device comprises a feed mechanism 40, which is equipped with a drive roll 34, driven in the direction of arrow 35, and a roll 36, which is freely rotatably mounted in a lever 37. This lever 37, pivotably mounted by a bolt 38 in the machine frame, is engaged by a spring 39, so that the lever presses the roll 36 against the drive apparatus 34.

The pile warp threads 7 are guided between the two rolls 34, 36 and are therefore positively drawn at constant speed, during operation, from the warp bobbins or from a warp beam. The rotational speed and diameter of the drive roll 34 are so suited to the operating speed of the strip loom, that the feed speed of the feed mechanism 40 corresponds to the mean thread demand.

The pile warp thread feed apparatus comprises also a storage mechanism 26. This is equipped with two guide rolls 24 and 25, freely rotatably journalled at some distance from each other, over which the pile warp threads are guided. The storage mechanism 26 furthermore comprises a lever 27, which is pivotally journalled on a pin 29. The lever 27 possesses at one end a roller 28, which is situated in the region of the space between the two guide rolls 24, 25 and engages on the pile warp threads 7. At the other end of the lever 27, a riding roll 31 is journalled. A tension spring 30 also engages the lever 27 in such a manner that the riding roll 31 is pressed against a cam disc 32, which is keyed onto a drive shaft 33. The lever 27 therefore constitutes a thread tensioning device. A slide could of course be used instead of a lever as a thread tensioning device.

From the storage mechanism 26, the pile warp threads 7 are then supplied via a guide 23 to the shed-forming device 16.

The drive shaft 33 and cam disc 32 together constitute a drive mechanism 32, 33, which, in operation, executes a rotational motion synchronous to the movement of the shed-forming device 16. When the cam disc 32 revolves, the roll 28 executes approximately one upward and downward movement. When it moves downwards, thread portions are stored between the guide rolls 24 and 25. The speed at which the pile warp threads are supplied to the shed-forming device is thereby reduced. When, by contrast, the roll 28 moves upwards, the stored portions of thread are released and the pile warp threads are accordingly supplied to the shed-forming device 16 at an increased speed. The cam disc 32 is so constructed that the pile warp threads 7 are supplied relatively slowly during those periods in which they are being woven into one of the basic weaves 1*b*, 2*b*. At those shed changes at which the connecting sections 7*c* or the nap loops 7*d* are formed, the pile warp threads 7 are then fed at a higher speed corresponding to the increased demand for thread.

The storage mechanism 26 therefore enables the pile warp threads 7 to be supplied to the shed-forming device 16 at always just the correct speed corresponding to the demand. Even when stiff pile warp threads are used, this prevents excessive stresses from occurring in the forming of the connecting sections 7*c* and the nap loops 7*d*. This enables the weaving speed to be considerably increased.

In an especially advantageous embodiment of the gripper 45, the hooks 47 are adjustable in height. The hooks can then be so adjusted that the rod 20, when in the vicinity of the fabric edge 11, is situated outside the plane of the strip, that is above or below the basic weave and no longer in contact with it. By adjusting the hooks, weaves having nap loops of differing sizes can be produced.

It is also possible to change the heights of the hooks 47 alternately during the weaving operation, so that loops of alternating differing sizes can be produced.

It is of course also possible, for the purpose of changing the size of the nap loops, to utilise rods, the end sections of which are of differing thicknesses. Experiments have demonstrated that it is readily possible to guide two rods in the same sleeve and to push them out alternately. Furthermore, the rods may be so constructed that their end sections sag during the forming of loops.

In this manner it is possible to produce nap loops of differing size. This may be of advantage under certain circumstances for strip closures.

It is furthermore advantageous for the pile warp threads to be so woven into the basic weave that the nap loops 7*d* of the end product stand diagonally and that the nap loops 7*d* of different rows or groups of rows possess differing directions. This form of the nap fabric strip has the advantage that the strip closure closes considerably better than when all the nap loops 7*d* possess the same orientation. In particular this results, for tensile stresses in the plane of the strip, in a strength which is relatively independent of the direction of pull.

For moving the rod end section, a separate element can of course be provided instead of the reed 15.

Some variants of the production of the strip are now explained below.

It is of course possible to provide different groups of pile warp threads. Loops can then be formed simultaneously on the upper and lower strip, so that a weave with a substantially denser nap results.

Furthermore, different types of thread can be used for the forming of the connecting sections and for the forming of the loops. For example it may be advantageous to utilise solid threads, that is single-fibre threads, for forming the mushroom-shaped knubs, and threads comprising a number of fibres for forming the loops. Since the latter are relatively flexible, they do not necessarily have to be supplied through the storage mechanism.

Figure 4:
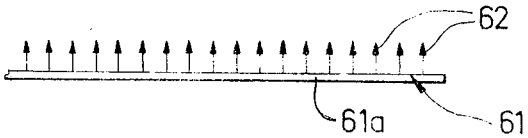
FIGS. 4 to 8 are diagrammatic side views of different strips.

It is of course also possible to form no nap loops in one of the two strips or in both strips. In this way, the strip 61 illustrated in FIG. 4 can be made, which possesses only a basic weave 61*a* and mushroom-shaped knubs 62.

Figure 5:
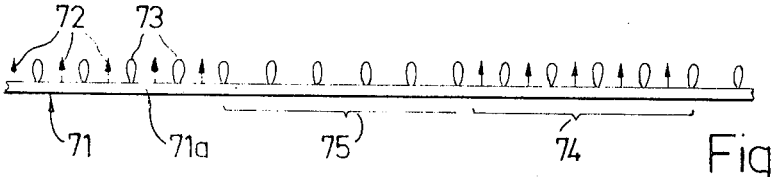

Furthermore, the shed-producing device and the storage mechanism may be so regulated that connecting sections are formed only during specific periods. If nap loops are then continuously formed, a strip of the type illustrated in FIG. 5 results. This strip, designated generally as 71, possesses a basic weave 71*a* and sections 74, which are furnished with mushroom-shaped knubs 72 and with nap loops 73. Between the sections 74, are situated sections 75 in which only nap loops are present.

Figure 6:
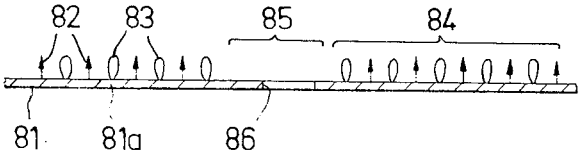

When the forming of nap loops also is interrupted, a strip of the type illustrated in FIG. 6 can be produced. This is designated 81 in general and comprises a basic weave 81*a*. In the sections 84, the strip 81 is furnished with mushroom-shaped knubs 82 and loops 83. Between these are situated sections 85, in which neither mushroom-shaped knubs nor loops are present. In the sections 85, holes 86 may then be punched, enabling the strip to be secured by buttons.

Figure 7:
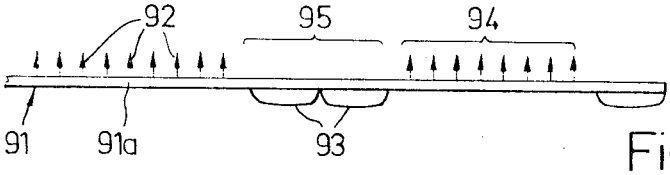

A further variant is illustrated in FIG. 7. This shows a strip 91 comprising a basic weave 91*a* and having sections 94, which are furnished with mushroom-shaped knubs 92. Between these are situated sections 95 comprising no knubs, but instead furnished on the rear face with loops 93, which are formed by floating pile warp threads and extend over several weft thread positions. These loops 93 may also be used for attaching the strip.

Figure 8:
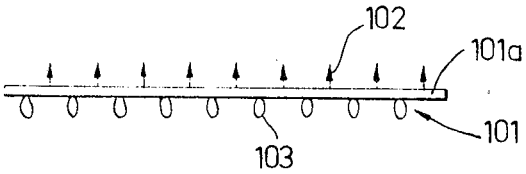

The rods serving for forming the nap loops may also be disposed on the outer faces of the strips. In this manner, it is then possible for the strip 101 illustrated in FIG. 8 to be made, which possesses on one side mushroom-shaped knubs 102 and on the other side nap loops 103.

It is also of course possible in this variant to regulate the shed forming and the feed of pile threads in such a way as to produce areas without knubs and loops.

Figure 9:
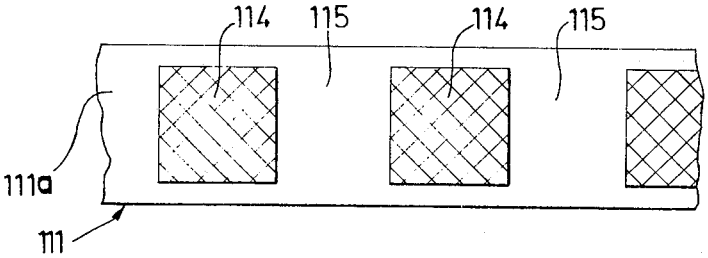
FIGS. 9 and 10 are plan views on strips of different forms.
Figure 10:
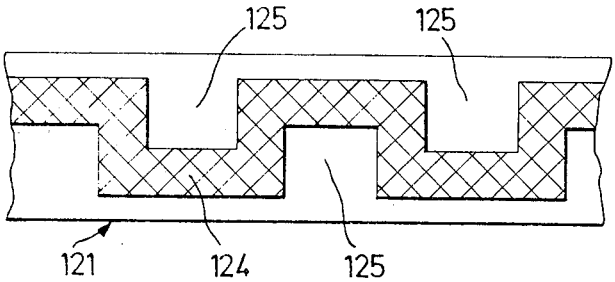

FIGS. 9 and 10 show plans on two strips which possess nap-free regions. The strip 111 comprises a basic weave 111*a* and rectangular regions 114, which are furnished with knubs. Between the regions 114 there are regions 115 extending over the entire width of the strip, which comprise no knubs.

In the strip 121, the knubs cover a continuous, meandering region 124. On both sides of the strip, there are alternated knub-free regions 125.

When the strip closure is closed, a hooking together evidently only occurs at those places where both strips comprise coupling means, that is mushroom-shaped knubs or nap loops respectively. When bending the closure, the two strips can bend independently of each other in the non-coupled regions. It is well-known that the bending resistance of an element is very much dependent upon its thickness. Two freely movable individual strips therefore possess a much smaller resistance to bending than two strips coupled together to form a relatively thick double strip. If the strip closure comprises non-coupled regions, it is much more easily bent than a strip closure furnished with coupling means over the entire surface. The high flexibility in particular makes it possible to close even a long strip closure tightly and smoothly, without difficulty and without the forming of undulations. Since the flexible strips adjust themselves readily to garments, they can be used both as edging strips and also for closures for knitted goods. In addition, the manufacture of the strip closure is made less expensive, since fewer nap threads are required and fewer knubs need to be formed.

A further process will now be described, with reference to FIG. 11, in which strips comprising hook-shaped knubs can be manufactured. In this method again, two strips 201 and 202, comprising basic weaves 201*b*, 202*b* respectively, are woven. The two basic weaves are woven from basic warp threads 203, 204 and 205, 206 respectively, and also from weft threads, not shown. The two strips 201, 202 are so guided that they comprise two mutually parallel sections 201*a*, 202*a*, respectively, between the fabric edges 211, 212, respectively and, the rolls 208, 209, respectively.

In the weaving operation, the basic warp threads of the two strips are divided by a shed-forming device 216 into sheds 217 and 219.

Weft thread loops are then introduced into these sheds by weft thread introducing devices 224, 225, and are beaten up by the reed 215 against the fabric edges.

In addition, pile warp threads 207 are supplied through the shed-forming device 216. These are woven into the two basic weaves during a period so that the sections 207*a* and 207*b* are formed. In between these periods, the pile warp threads 7 constitute connecting sections, which join together the two strip sections 201*a* and 202*a*. By contrast to the example illustrated in FIG. 1, S-shaped connecting sections are formed here however, not straight ones.

The forming of these connecting sections will now be described in more detail. First of all, the pile warp threads 207 are supplied through the shed-forming device 216 in such a way that they are woven into the strip 201.

The pile warp threads are then raised sufficiently far by the shed-forming device 216 to enable a rod 221 to be pushed in beneath them in the upper half of the intervening space between the two strips. The pile warp threads are however only lifted so far that they are not woven into the upper strip.

Figure 11:
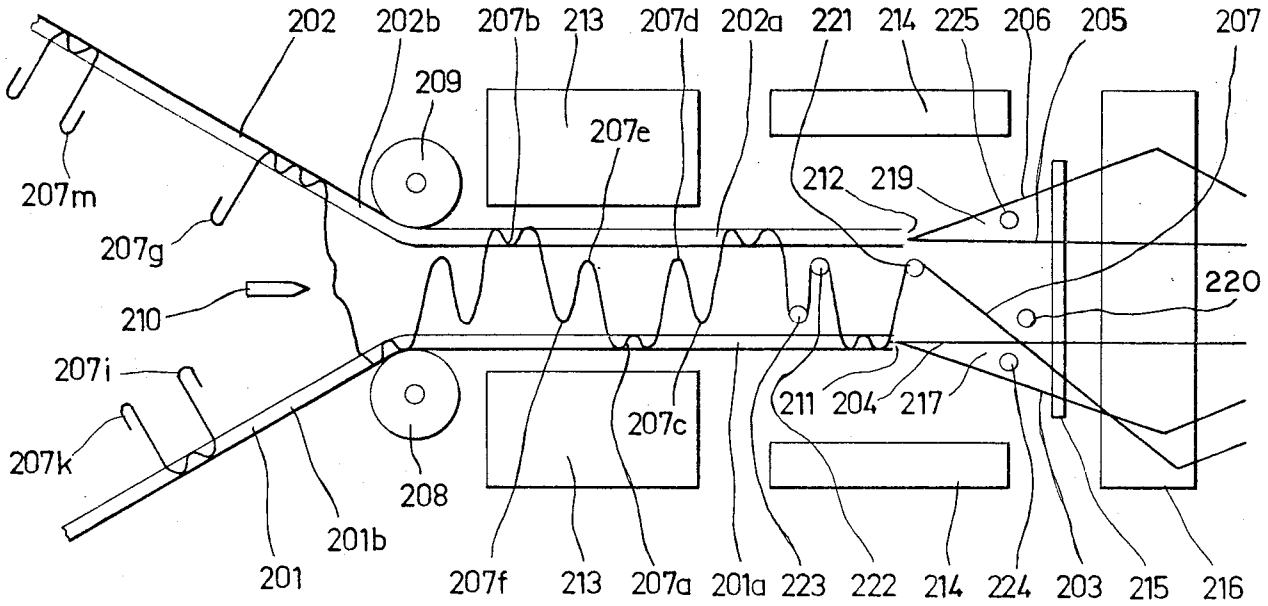
FIG. 11 is a diagrammatic lateral section through another strip loom.

At the next shed change, the pushed-in end section of the rod 221 is bent by the reed 215 into the position depicted in FIG. 11 in the vicinity of the fabric edge 212, and is held there by a gripper. The pile warp threads are now lowered, as can be seen in FIG. 11. This lowering is continued sufficiently far until the rod 220 situated in the region of the lower half of the intervening space between the two strips can be pushed over the pile warp threads 207, without these threads being woven into the lower strip 201.

At the next shed change, the pile warp threads 207 are then raised sufficiently far to be woven into the upper strip. Simultaneously, the rod 220 is bent by the reed into the vicinity of the fabric edge 211 of the lower strip 201.

The thread sections wrapped around the rod 221 then form the loops 207*d*. By wrapping around the rod 220, the loops 207*c* are formed. The pile warp threads are heated during the loop forming by means of the heating elements 214 and are then cooled as the strips are conveyed onwards by means of the cooling elements 213. The loops are thereby stabilised, so that stable connecting sections 207*c*, 207*d*, possessing the S-shape already referred to, are formed.

In order that the desired S-shape shall be accurately produced, it is advantageous for the rods 220 and 221 to remain in the loops somewhat longer beyond the fabric edges. For this purpose, they may with advantage be conveyed onwards with the strip by the gripper, not shown.

The S-shaped connecting sections 207*e*, 207*f* can then be formed in a corresponding manner using the same rods, or as is shown in FIG. 11, using two other rods 222 and 223.

In addition, the four rods 220, 221, 222, 223 may be constructed similarly to the rod 20 shown in FIGS. 2 and 3. They may then be pushed in, for the purpose of forming the loops, by means of drive devices, approximately perpendicularly to the warp threads, into the intermediate space between the two basic warps 203, 204, and 205, 206 respectively.

At the rolls 208 and 209, the strips 201, 202 respectively are deflected and pulled apart. The connecting sections are here stretched. At that position at which they are fully stretched, they are cut in two at the centre by a separating device 210.

The separating device 210 may be formed, for example, by a reciprocating, strip-shaped knife. It should in any case be so constructed that no thickening occurs at the cutting points. After cutting, the connecting sections, now cut in two, re-adopt their curved shape, so that the hooks 207*g*, 207*i*, 207*k*, 207*m* are produced from the original loops 207*c*, 207*d*, 207*e*, 207*f*.

I claim:

1. A method of manufacturing nap fabric strips for strip closure devices comprising the steps of simultaneously weaving, from respective weft and first warp threads, two fabric strips having mutually facing surfaces spaced from each other; during such weaving, weaving second warp threads alternately into said strips so that portions of said second warp threads interconnect said strips; while said second warp threads are being woven into said strips, feeding said second warp threads at a first feed rate; while the interconnecting portions are being formed, feeding said second warp threads at a second feed rate greater than said first feed rate; using rod members to guide interconnecting portions of said second warp threads along substantially S-shaped paths; stabilizing the shape of the thus guided interconnected portions; and cutting each stabilized interconnecting portion to disconnect said strips from each other and to provide each strip with a plurality of knubs which are hook-shaped.

2. A method as defined in claim 1, in which each second warp thread is guided to alternately form an interconnecting portion and a nap loop.

3. A method as defined in claim 1, comprising the steps of applying heat to said warp threads in the vicinity of the sheds and in the vicinity of the fabric edges.

4. A shuttle-less strip loom for manufacturing nap fabric strips for strip closure devices, said loom comprising, in combination, first supply means operable to supply two sets of first warp threads; second supply means operable to supply a set of second warp threads; a shed-forming device adapted to divide each set of first warp threads supplied thereto into respective sheds to simultaneously weave, in said loom, two fabric strips having mutually facing spaced surfaces, and to guide the second warp threads supplied thereto in such a manner that the second warp threads are woven alternately into said two strips, with portions of the second warp threads interconnecting said strips; at least two flexible rod members displaceable laterally into the space between said strips to extend substantially perpendicularly to said strips, said rod members being movable lengthwise of said strips to engage the interconnecting portions of said second warp threads to form said interconnecting portions to have an S-shape stabilizing means operable to stabilize said portions in said S-shape; and cutter means operable to engage and cut said S-shape interconnecting portions to form knubs extending from each of said strips and having hook ends.

5. A shuttle-less strip loom, as defined in claim 4, where in said stabilizing means includes at least one heating element operable to heat the warp threads in the zone of the sheds and the fabric edges.

* * * * *